United States Patent [19]

Uematsu et al.

[11] Patent Number: 4,769,514

[45] Date of Patent: Sep. 6, 1988

[54] LEAD ALLOY FOIL FOR LAMINATED TAPE

[75] Inventors: Tadayuki Uematsu, Chiba; Teruo Fukuda; Tomohiro Toda, both of Ichihara; Atsushi Mori; Yoshitaka Tamura, both of Oosaka; Keizo Kasahara, Moriyama, all of Japan

[73] Assignee: The Furukawa Electric Co., Ltd., Tokyo, Japan

[21] Appl. No.: 145,648

[22] Filed: Jan. 13, 1988

Related U.S. Application Data

[63] Continuation of Ser. No. 845,177, Mar. 27, 1986, abandoned.

[30] Foreign Application Priority Data

Apr. 11, 1985 [JP] Japan ..... 60-78106
Oct. 30, 1985 [JP] Japan ..... 60-243674

[51] Int. Cl.[4] ..... H01B 7/20; H01B 7/22; B32B 15/08

[52] U.S. Cl. ..... 174/102 A; 174/102 SC; 174/106 SC; 428/461

[58] Field of Search ..... 428/606, 607, 461, 408; 420/571, 572; 174/102 A, 102 SC, 106 SC; 252/511

[56] References Cited

U.S. PATENT DOCUMENTS

| | | | |
|---|---|---|---|
| 97,972 | 12/1869 | Shaw | 420/571 |
| 1,075,661 | 10/1913 | McConnell | 420/571 |
| 1,766,871 | 6/1930 | Beckinsale et al. | 420/571 |
| 1,807,788 | 6/1931 | Kemp | 420/569 |
| 1,896,473 | 2/1933 | Townsend | 148/405 |
| 2,180,139 | 11/1939 | Deitz | 420/571 |
| 4,465,615 | 8/1984 | Hata et al. | 252/511 |
| 4,545,926 | 10/1985 | Fouts et al. | 252/511 |

FOREIGN PATENT DOCUMENTS

| | | | |
|---|---|---|---|
| 3306501 | 8/1984 | Fed. Rep. of Germany | 174/102 D |
| 702261 | 4/1931 | France . | |
| 762488 | 4/1934 | France . | |
| 50-22712 | 3/1975 | Japan . | |
| 10303 | 1/1983 | Japan | 252/511 |
| 53932 | 3/1983 | Japan | 252/511 |
| 53935 | 3/1983 | Japan | 252/511 |
| 218703 | 12/1983 | Japan | 252/511 |
| 62656 | 4/1984 | Japan | 252/511 |
| 66436 | 4/1984 | Japan | 252/511 |
| 168051 | 9/1984 | Japan | 252/511 |
| 129617 | 1/1985 | Japan | 252/511 |
| 120769 | 6/1985 | Japan | 252/511 |
| 25090 | of 1912 | United Kingdom . | |

OTHER PUBLICATIONS

S. A. Hiscock, Lead and Lead Alloys for Cable Sheathing, Ernest Bann Ltd., London, 1961, Tables 18, 20, 21.

*Primary Examiner*—John J. Zimmerman
*Attorney, Agent, or Firm*—Frishauf, Holtz, Goodman & Woodward

[57] ABSTRACT

This invention provides a lead alloy foil comprising 0 to 4 wt % of tin, 0.5 to 7.0 wt % of antimony, and the balance being lead, wherein Sn/Sb ratio is 3 or less. It also provides a lead laminated tape for covering cables, comprising a lead alloy foil comprising 0 to 4 wt % of tin, 0.5 to 7.0 wt % of antimony, and the balance being lead, wherein Sn/Sb ratio is 3 or less, and an electrically conductive plastic film laminated at least one of the surfaces of the lead alloy foil and having a volume resistivity of $10^6$ Ω-cm or less.

14 Claims, 1 Drawing Sheet

LEAD ALLOY FOIL FOR LAMINATED TAPE

This application is a continuation of application Ser. No. 845,177, filed Mar. 27, 1986, now abandoned.

BACKGROUND OF THE INVENTION

The present invention relates to a lead alloy foil for a laminated tape hereinafter referred to as "lead alloy foil" and a lead laminated tape using the foil, both designed for covering cables.

Generally, power cables insulated with rubber or plastics to withstand high voltages have the structure shown in FIG. 1. More specifically, such a cable comprises conductor 1, conductor shield 2 covering conductor 1, insulation layer 3 covering layer 2 and made of polyethylene, crosslinked polyethylene, ethylenepropylene rubber, or the like, insulation shield 4 covering insulation layer 3, metal shield layer 5 covering layer 4 and made of copper tape, copper wire, aluminum wire, or the like, and, if necessary, jacket 6 covering metal shield layer 5.

In a power cable of the structure described above, water infiltration may occur either along the conductor or from the outside to the inside of the cable, through the ends, splicing portions, and/or the jacket, during the manufacture, storage, installation or use of the cable. Water may penetrate from the conductor to the conductor shield and thence to the insulation layer. When AC voltage is applied to the cable insulation into which much water has infiltrated in this manner, fine defects called "water-trees" are formed in the insulation layer. These water-trees degrade the insulation characteristics of the insulation layer and may cause an electrical failure of the cable after a long use.

Accordingly, it is strongly demanded today that water should be prevented from infiltrating into high-voltage power cables insulated with rubber or plastics.

It has been proposed that a water impervious layer comprising a foil, such as lead foil and lead alloy foil having a thickness of several microns, should cover the insulation layer of the cable or be provided under the anti-corrosion plastic jacket of the cable. This is because the lead or lead alloy foil is very flexible and resistant to chemicals. Such lead or lead alloy foil is actually used in some of the power cables available at present.

More precisely, the lead foil or lead alloy foil, both hereinafter referred to as "lead foil", is used as a component of a laminated tape. The laminated tape comprises the lead foil and an electrically conductive or insulating, plastic film laminated on one surface of the foil, or two such plastic films laminated on both surfaces of the foil. The tape is formed around the conductor and/or core of a cable, by the process called "longitudinal application." The laminated tape is then thermally bonded to a layer covering the cable core or an anti-corrosion plastic jacket, thereby forming an water impervious layer.

This method of forming the impervious layer is advantageous over the conventional method wherein lead is extruded over the cable core; it can form a lead foil thinner than in the conventional method, and hence helps to lighten power cables.

However, several problems arise from the use of the laminated tape having a foil made of pure lead or lead alloy consisting of 5 wt. % (weight percent) of tin, 2 wt. % of antimony, and the balance being lead and having a thickness of 50 to 100 microns. More precisely, the foil of lead or lead alloy is disadvantageous in the following respects:

(1) Its mechanical strength is insufficient, making it difficult to form the water impervious layer during the manufacture.

(2) It has inadequate fatigue characteristics, and is very likely to break when bent once or repeatedly. In short, it does not have an enough fatigue strength.

(3) It will have pinholes or cracks when formed to have a thickness of 50 microns or less. In other words, it cannot be made 50 microns thick or thinner.

(4) It encounters surface corrosion shortly after manufacture, reducing the bonding strength between it and plastic films.

SUMMARY OF THE INVENTION

The inventors hereof carefully studied the composition of lead alloy and the functions of lead alloy incorporated in laminated tapes, in an attempt to resolve the aforementioned problems. They at last found that a lead alloy consisting of 0–4 wt. % of tin, 0.5–7 wt. % of antimony, and the balance being lead (where Sn/Sb ratio ranges from 3 to 0) was superior in the film formability and was free of the drawbacks inherent in the conventional lead foils. The inventors laminated an electrically conductive plastic film of a volume resistivity of $10^6$ Ω-cm or less on at least one surface of this lead alloy foil, thus making a lead laminated tape. The lead laminated tape was found to be far stronger, far more formable, and far more resistant to fatigue and corrosion than the conventional lead laminated tapes. Hence, the inventors obtained their objective.

According to the present invention, there is provided a lead alloy foil and also a lead laminated tape using the foil, both designed for covering cables. The foil is made of a lead alloy consisting of 0–4 wt. % of tin, 0.5–7.0 wt. % of antimony, and the balance being lead (where Sn/Sb ratio ranges from 3 to 0), preferably made of a lead alloy consisting of 0–4 wt. % of tin, 3.0–7.0 wt. % of antimony, and the balance being lead (where Sn/Sb ratio is 0–1). As shown in FIG. 2, the lead laminated tape comprises lead alloy foil 7 and an electrically conductive plastic film 8 having a volume resistivity of $10^6$ Ω-cm or less laminated on one surface of foil 7. Alternatively, the tape comprises lead alloy foil 7 and two electrically conductive plastic films 8 having a volume resistivity of $10^6$ Ω-cm or less and sandwiching foil 7, as illustrated in FIG. 3. Further, the tape may comprise lead alloy foil 7, an electrically conductive plastic film 8 having the same volume resistivity and formed on one surface of foil 7, and an electrically insulating plastic film 9 formed on the other surface of foil 7.

The present invention is characterized by the ranges of the Sn and Sb content and the range of the Sn/Sb ratio of the lead alloy forming the foil.

The content of Sn must be 0 to 4 wt. %. This is because, when the lead alloy contains more than 4 wt. % of Sn, the resultant foil is not so strong as desired, elongates too much, and has insufficient fatigue characteristics.

The content of Sb must be 0.5 to 7 wt. %, preferably 3 to 7 wt. %. When the lead alloy contains less than 0.5 wt. % of Sb, the resultant foil has an insufficient strength and inadequate fatigue characteristics, cannot form a sufficiently foil, be greatly resistant to corrosion, and cannot be bonded firmly to electrically conductive plastic films and thus has insufficient characteristics for long use. When the lead alloy contains more than 7 wt.

% of Sb, it is too hard, too brittle, less resistant to corrosion than desired, and cannot form a sufficiently foil.

The Sn/Sb ratio, i.e., ratio of the Sn content to the Sb content, must be 3~0, preferably 0~1. This is based on the results of the experiments the inventors conducted. In the experiments, various lead alloys of different Sn/Sb ratios were prepared and tested. As a result, these metals presented a marked synergetic effect when the Sn/Sb ratio was 3 or less.

The electrically conductive plastic film having a resistivity of $10^6$ Ω-cm or less must be laminated on at least one surface of the lead alloy foil for the following reason. The lead laminated tape of this invention is designed to be interposed between the conductor and insulation layer of a cable, between the insulation layer and insulation shield of the cable, or between the insulation shield and metal shield layer of the cable, or directly under the plastic jacket of the cable, where a potential gradient exists. It is necessary to reduce the electric field generated at the interface between any two adjacent layers, a semi-conductive plastic film must be applied on at least one surface of the foil. If necessary, another conductive plastic film or insulating plastic film is laminated on the other surface of the lead alloy foil, thereby forming a water impervious layer.

Since a plastic film is formed on one or both surfaces of the lead alloy foil, the lead laminated tape not only has a great mechanical strength and excellent fatigue characteristics, but also is greatly resistant to corrosion.

When the lead laminated tape with two plastic films is wound, the overlapping portions of any two adjacent turns of the tape are strongly bonded to each other due to the fusing of the plastic films, thereby forming a excellent water impervious layer.

DETAILED DESCRIPTION OF THE PREFERRED EMBODIMENTS

Figure 1:
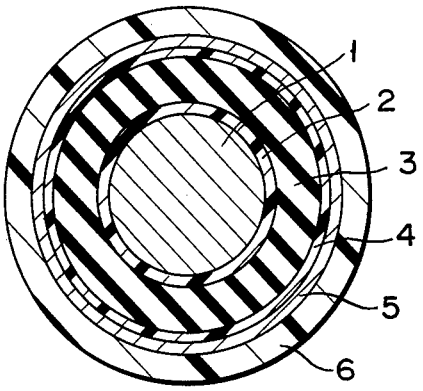
FIG. 1 (PRIOR ART)
FIG. 1 is a cross-sectional view of a conventional power cable insulated with rubber or plastics.
Figure 2:
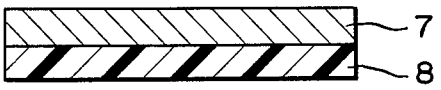
FIG. 2 is a cross-sectional view of an example of a lead laminated tape according to the present invention.
Figure 3:
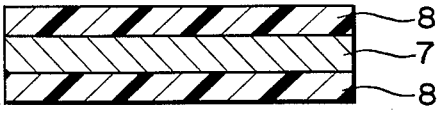
FIG. 3 is a cross-sectional view of an another example of a lead laminated tape according to this invention.
Figure 4:
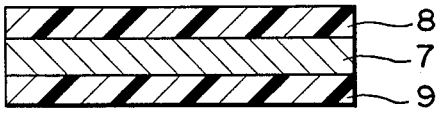
FIG. 4 is a cross-sectional view of a still another example of a lead laminated tape according to the present invention.

The electrically conductive plastic film used in the invention will be first explained. Hitherto, many attempts have been made to laminate a lead foil with an electrically conductive plastic film. It has been proposed that the film be made of a heat-fusing, electrically conductive polymer such as polyolefin. However, polyolefin is generally non-polar and chemically inert, and its adhesivity with lead foil is insufficient. Hence, polyolefin cannot be practically used.

Further, the adhesiveness of polyolefin will decrease since carbon black, carbon fiber, graphite or the like is necessarily added to the plastic in an amount of 10 to 50 wt. %, thereby maintaining the volume resistivity at $10^6$ Ω-cm or less. When the conductive plastic film of polyolefin was used, thus forming the water impervious layer of a power cable, it was liable to peel off when the cable was bent. The plastic film could not remain laminated with the lead alloy foil over a long use of the power cable.

The inventors hereof carefully studied various plastic films of this type which are available at present in order to obtain a plastic film which is very electrically conductive, has good bondability with lead foil, and is greatly heat-sealable. They found out that the most desirable was an electrically conductive, heatsealable plastic film comprising the following components 1, 2 and 3:

1. 40–100 parts by weight of a mixture comprising ethylene-acrylic acid copolymer and/or ethylene-ethyl acrylate copolymer, and/or unmodified polyolefin and modified polyolefin prepared by grafting or adding unsaturated carboxylic acid or its derivatives, epoxy group-containing unsaturated carboxylic acid or its derivatives, and an epoxy group-containing unsaturated compound to polyolefin, thus forming polar functional group, said unsaturated carboxylic acid or its derivatives, said epoxy group-containing unsaturated carboxylic acid or its derivatives and said epoxy group-containing unsaturated compound being used in an amount of 0.01~1.0 wt. % based on the mixture of the modified and unmodified polyolefins;

2. 0–60 parts by weight of at least one polyolefin selected from the group consisting of polyethylene, ethylene-vinyl acetate copolymer and non-polar, polyolefin-based, low crystalline resin; and 3. 5–140 parts by weight of at least one electrically conductive material selected from the group consisting of carbon black, carbon fiber and graphite, based on 100 parts by weight of component 1 or a resin consisting of components 1 and 2.

As the ethylene-acrylic acid copolymer (EAA), use can be made of any copolymer that has been prepared by the known method such as the high-pressure process or the emulsion polymerization process performed under a high pressure, and containing 1–20 wt. % of acrylic acid (AA). In this invention, copolymers containing 3–15 wt. % of acrylic acid are preferred.

As the ethylene-ethyl acrylate copolymer (EEA) use can be made of any copolymer that contains 5–25 wt. % of ethyl acrylate (EA). GA-Series acid modified adhesive resins (GA002–GA004) manufactured by Nippon Unica are preferable.

As the unsaturated carboxylic acid used to modify the unmodified polyolefin mixture, fumaric acid, acrylic acid, itaconic acid, maleic acid, and the like can be used. For the derivatives of carboxyl acid, use can be made of acid anhydride, acid halide, acid ester, acid amide, acid imide and the like. For the epoxy group-containing unsaturated compounds, glycidyl methacrylate monomer, etc. can be used. Polypropylene grafted with maleic anhydride is a desirable compound.

The unsaturated carboxylic acid and epoxy group-containing unsaturated compounds must be used in an amount of 0.01–1.0 wt. % based on the mixture of the modified and unmodified polyolefins. When its amount is less than 0.01 wt. %, the desired results cannot be obtained. When its amount exceeds 1.0 wt. %, there will be no advantages. Rather, due to the unreacted compounds, the resultant plastic film will be deteriorated when heated.

To modify polyolefin, the polyolefin is treated in a solvent bath or melt-kneaded in an extruder in the presence of organic peroxide, as commonly practiced in the art.

As the polyethylene, high-density polyethylene or low-density polyethylene can be used.

It is desired that the ethylene-vinyl acetate copolymer contain 5–48 wt. % of vinyl acetate. When such copolymer is used, 70% or more of its acetoxy group can be hydrolyzed into hydroxyl group.

The non-polar polyolefin-based low crystalline resin is any one of those containing virtually no polar group such as chlorine, acetic acid group or double bond. The resin is preferably greatly elastic, having an elongation at failure of 400–1,000%. For example, a non-polar, ethylene-α-olefin copolymer such as Tafmer Series (trademark) manufactured by Mitsui Petrochemical Co., Ltd., can be used. As mentioned above, the mixture of two or more resins can be used as component 2.

As the carbon black, various acetylene blacks and furnace blacks, all being electrically conductive, can be used. Of these carbon blacks, Ketjenblack EC (trade name, made by AKZO, Inc.) which has a marked electrical conductivity, is optimum. Moreover, carbon fiber or graphite having a particle size of 0.1–40 μm can be used. When carbon black and carbon fiber or graphite are used together, the resultant plastic film has improved properties. Components 1 and 2 are mixed in a weight ratio ranging from 100:0 to 40:60.

The greater the content of component 1, the greater adhesiveness with lead alloy foil or other plastic films. However, when too much carbon black is used, the molten film plastic has its flowability reduced, the resultant film has an insufficient elongation and an inadequate flexibility. Hence, a plastic film made of an electrically conductive, heat-adhesive resin composition consisting of components 1 and 3 cannot be efficiently laminated with lead alloy foil by the film lamination process or the melt lamination process. In other words, a plastic film or adhesive film has insufficient formability, and cannot be formed so as to have sufficient adhesiveness with lead foil.

Unexpectedly, however, the formability of film improved and the adhesiveness of the film rose when component 2, i.e., at least one polyolefin selected from the group consisting of polyethylene, ethylene-vinyl acetate copolymer and non-polar, polyolefin-based, low crystalline resin, was added to the resin composition consisting of components 1 and 3.

When component 2 is used in an excessively large amount, the adhesiveness of the plastic film with lead alloy foil decreases, making it difficult to attain the desired lamination effect. In view of this, it is preferable that the mixing ratio of component 1 to component 2 be 95:5 to 50:50, depending on the conditions of the forming process, though it can range from 100:0 to 40:60.

Five to 140 parts by weight of component 3, i.e., the electrically conductive material, is added to 100 parts by weight of the mixture of components 1 and 2. When only carbon black is used as component 3, 90 or less parts by weight must be added. When only carbon fiber must be used as component 3, 30 or less parts by weight is used. When only graphite is used as component 3, 30–140 parts by weight must be used. Otherwise, the plastic film cannot have an electrical conductivity of $10^6$ Ω-cm or less. As to carbon black, 80 or less parts by weight is a preferred amount, and 70 or less parts by weight is a more preferred amount. Similarly, When carbon black and carbon fiber or graphite are used, it is desired that the mixture be used in an amount of 80 parts by weight or less, preferably 70 parts by weight or less. However, when component 3 is used in an insufficient amount, the conductive plastic film cannot have the desired electrical conductivity. When component 3 is used in an excessively great amount, the conductive plastic film cannot have the desired mechanical properties.

Some additives can be used in addition to components 1, 2 and 3 to form the electrically conductive, heat-adhesive plastic film. For example, a stabilizer, a lubricant, a flame detardant a reinforcing agent, and the like can be added, either singly or in combination, in appropriate amounts.

Various methods can be performed under various conditions to laminate the electrically conductive plastic film of this invention with a lead alloy foil. For instance, the film can be pressed onto the lead foil while being heated to a temperature above the melting point of its material. Alternatively, the plastic film can be directly extrusion-coated on the lead alloy foil. Further, the film can be directly melt-laminated with the foil. Still further, the film and the foil are put together, and are then heated under pressure.

The present invention will now be described in greater detail, with reference to several examples.

EXAMPLE 1

Fourteen Pb-Sn-Sb alloys of the compositions shown in Table 1 were melted at 400° C. in the atmosphere. The molten alloys were cast into moulds, thereby providing strips of the lead alloys. The strips were rolled at room temperature, thus forming 14 lead alloy foils. Of the fourteen alloys, alloys No. 1 to No. 10 had the compositions according to the present invention, and alloys No. 11 to No. 14 were controllers whose compositions fall outside the scope of the invention. Foils No. 1 to No. 14 were tested, thereby measuring their strengths, fatigue characteristics, corrosion resistances, pinhole densities. The foil formability of each alloy was also evaluated.

Electrically conductive plastic films having a volume resistivity of $10^3$ Ω-cm were formed of a composition consisting of 75 parts by weight of ethylene-acrylic acid copolymer (containing 8.0 wt. % of acrylic acid), 25 parts by weight of carbon black (Ketjenblack EC made by AKZO, Inc.). These films had a thickness of 100 μm. The plastic films were thermally fused to both surfaceS of the foils made of lead alloys No. 1 to No. 14, at 130° C. under pressure of 5 kg/cm$^2$, thereby forming lead laminated tapes. The lead laminated tapes were tested, thereby measuring their film-foil bonding strengths, fatigue characteristics, corrosion resistance, cable formability and heat-sealability. Then, these lead laminated tapes were incorporated in power cables as a water impervious layer. The resultant cables were tested, whereby their water-imperviousness, bending characteristics and heat cycle efficiencies were measured. The results of the various tests are shown in Table 1.

TABLE 1

| | | Composition (Wt %) | | | | Lead Alloy Foil | | | | |
|---|---|---|---|---|---|---|---|---|---|---|
| | Samples | Sn | Sb | (Sn/Sb) | Pb | Foil Formability | Strength | Fatigue Characteristics | Corrosion Resistance | Pinhole Density (holes/m$^2$) |
| This | No. 1 | 0 | 4.0 | 0 | Remains | ◎ | 1.25 | 1.50 | ◎ | 0 |

TABLE 1-continued

| | | | | | | | | | | |
|---|---|---|---|---|---|---|---|---|---|---|
| Invention | No. 2 | 2.5 | 3.5 | 0.71 | " | ⊙ | 1.30 | 1.70 | ⊙ | 0 |
| | No. 3 | 3.5 | 5.5 | 0.64 | " | ⊙ | 1.35 | 1.80 | ⊙ | 0 |
| | No. 4 | 1.0 | 7.0 | 0.14 | " | ⊙ | 1.30 | 1.50 | ⊙ | 0 |
| | No. 5 | 0.5 | 2.0 | 0.25 | " | ⊙ | 0.95 | 1.10 | ⊙ | 0 |
| | No. 6 | 2.0 | 1.0 | 2.0 | " | ⊙ | 0.95 | 1.10 | ⊙ | 0 |
| | No. 7 | 2.0 | 2.0 | 1.0 | " | ⊙ | 1.30 | 1.15 | ⊙ | 0 |
| | No. 8 | 3.5 | 2.0 | 1.8 | " | ⊙ | 1.10 | 1.25 | ⊙ | 0 |
| | No. 9 | 3.5 | 6.0 | 0.58 | " | ⊙ | 1.35 | 1.55 | ⊙ | 0 |
| | No. 10 | 4.0 | 1.5 | 2.7 | " | ⊙ | 1.08 | 1.50 | ⊙ | 0 |
| Controllers | No. 11 | 5.0 | 7.0 | 0.71 | " | X | 1.80 | 0.70 | Δ | 1–10 |
| | No. 12 | 5.0 | 2.0 | 2.5 | " | ○ | 1.00 | 1.00 | ○ | 1–5 |
| | No. 13 | 4.0 | 3.0 | 1.3 | " | Δ | 1.10 | 0.65 | Δ | 1–10 |
| | No. 14 | 0 | 0 | 0 | " | Δ | 0.75 | 0.60 | X | many holes |

| | | Lead Laminated Tape with Two Films | | | | Properties of Cable | | |
|---|---|---|---|---|---|---|---|---|
| | Samples | Adhesivity (with EAA) | Fatigue Characteristics | Cable Formability | Heat-sealability | Water imperviousness | Bending characteristic | Heat Cycle efficiency |
| This Invention | No. 1 | 5 | 5 | 5 | 5 | 5 | 5 | 5 |
| | No. 2 | 5 | 5 | 5 | 5 | 5 | 5 | 5 |
| | No. 3 | 5 | 5 | 5 | 5 | 5 | 5 | 5 |
| | No. 4 | 5 | 5 | 5 | 5 | 5 | 5 | 5 |
| | No. 5 | 4 | 4 | 5 | 5 | 5 | 4 | 4 |
| | No. 6 | 4 | 4 | 5 | 5 | 5 | 4 | 4 |
| | No. 7 | 4 | 4 | 5 | 5 | 5 | 4 | 4 |
| | No. 8 | 5 | 4 | 5 | 5 | 5 | 4 | 4 |
| | No. 9 | 5 | 5 | 5 | 5 | 5 | 5 | 5 |
| | No. 10 | 5 | 4 | 5 | 5 | 5 | 4 | 4 |
| Controllers | No. 11 | 3 | 4 | 3 | 5 | 1 | 3 | 3 |
| | No. 12 | 4 | 4 | 5 | 5 | 5 | 3 | 3 |
| | No. 13 | 3 | 4 | 3 | 5 | 1 | 3 | 3 |
| | No. 14 | 2 | 3 | 1 | 5 | 1 | 1 | 1 |

In Table 1, marks ⊙, ○, Δ and x represent "excellent," "good," "fair" and "poor" respectively. The various properties shown in the table were evaluated in the following manner.

I. Properties of Foils (1) The foil formability was rated in accordance with whether the foils had cracks and slackening portions, whether they were stained with rolling agent, and whether they could be rolled into desired thickness.

(2) The strength and fatigue characteristic were evaluated in comparison with those of the foil of alloy No. 12, i.e., Sn(5 wt. %)-Sb(2 wt. %)-Pb, regarded as having reference value of 1.0. The fatigue test was conducted by MIT fold tester [JIS (Japanese Industrial Standard) P 8115]. The test pieces had a width of 15 mm and a length of 120 mm. The test pieces were repeatedly bent at the same portion, each time at 135°, with a tension of 250 g applied to them. The fatigue characteristic of each foil was evaluated in the number of bendings until it was broken.

(3) The corrosion resistance was measured by spraying 5% salt water over the test pieces at 35° C. for 1,000 hours, and then by observing the surface corrosion of the pieces.

(4) The pinhole density was measured in dark room by holding the foils up to lights, by counting the pinholes found in the foils, and calculated the number of pinholes per square meter.

II. Properties of Laminated Tape (1) The adhesiveness was rated in the following way. The electrically conductive plastic films were laminated with the lead alloy foils under the same conditions. The resultant laminated tapes were cut into test pieces each having a width 10 mm and a length of 150 mm. These test pieces were subjected to peeling test using a Tensiron tensile tester. The tester pulled the pieces at rate of 100 mm/min and at peel angle of 180°. The adhesiveness (kg/cm) of the tapes was evaluated in the following five levels:

| Level | Adhesiveness (kg/cm) |
|---|---|
| 5 | Greater than 1.5 |
| 4 | 1.0–1.5 |
| 3 | 0.5–1.0 |
| 2 | 0.2–0.5 |
| 1 | Less than 0.2 |

(2) The fatigue characteristics of the tapes were rated in the following way. The laminated tapes were cut into pieces each having a width of 15 mm and a length of 120 mm. These test pieces were tested by MIT fold tester (JIS P 8115). More specifically, they were repeatedly bent at the same portion, each time at 135°, with a tension of 250 g applied to them. The fatigue characteristic of each lead alloy foil was evaluated in the number of bendings until it was broken. The fatigue characteristics thus obtained were evaluated in the following five levels:

| Level | Number of Bendings |
|---|---|
| 5 | More than 5,000 |
| 4 | More than 2,000 |

-continued

| Level | Number of Bendings |
|---|---|
| 3 | More than 1,000 |
| 2 | More than 500 |
| 1 | 0–500 |

(3) The heat-sealabilities of the tapes were measured in the following manner. Two pieces of each laminated tape were laid one upon the other, and fused at 100 ° C. for 30 seconds. The resultant product was cooled and tested by measuring the mutual adhesiveness of the two pieces. The heat-sealabilities were rated in the following five levels (adhesiveness of heat-seal):

| Level | Heat-sealability (kg/cm) |
|---|---|
| 5 | Greater than 1.5 |
| 4 | 1.0–1.5 |
| 3 | 0.5–1.0 |
| 2 | 0.2–0.5 |
| 1 | Less than 0.2 |

III. Properties of Cable (1) The water-imperviousness of the cables with the laminated tapes used as water impervious layers were rated in the following way. First, the water content of the insulation shield of each cable was measured. The cable was sealed at both ends, and a hole having a diameter of 5 mm was cut in the jacket. Then, the cable was immersed in hot water maintained at 70° C. for one month. The cable was taken out of the hot-water bath, and the water content of the insulation shield directly under the water impervious layer or the insulation layer was measured and compared with the value obtained before the cable was immersed in the hot water. Based on the results of comparison, the water-imperviousness of the cable was rated in the following two levels, 1 and 5:

| Level | Water-imperviousness |
|---|---|
| 5 | No change in water content |
| 1 | Increase in water content |

(2) The bending characteristics of the cables were measured by repeatedly bending the cables along an arc of a diameter six times greater than the outer diameter of the cables. The bending characteristic of each cable was evaluated in the number of bendings repeated until cracks were formed in the lead alloy foil of the water impervious layer. The bending characteristics thus evaluated were rated in the following five levels:

| Level | Number of Bending Cycles |
|---|---|
| 5 | More than 15 |
| 4 | More than 10 |
| 3 | More than 5 |
| 2 | 3–5 |
| 1 | Less than 3 |

(3) The heat cycle efficiency of the cables was measured in the following manner. Each cable was bent along an arc of a diameter ten times greater than the outer diameter of the cable. The cable thus bent was inserted a conduit pipe. The conduit pipe was sealed at both ends. An electrical current was made to flow through the inner conductor of the cable, heating the conductor to 130° C. Then, the supply of the current was stopped, cooling the conductor to room temperature. The conductor was repeatedly heated and cooled in this way. The heat cycle efficiency of each cable was evaluated in the number of heat cycles repeated until cracks were formed in the lead alloy foil of the water impervious layer. The bending characteristics thus evaluated were rated in the following five levels:

| Level | Number of Heat Cycles |
|---|---|
| 5 | More than 70 |
| 4 | More than 50 |
| 3 | More than 30 |
| 2 | 10–30 |
| 1 | Less than 10 |

EXAMPLE 2

Three sets of 14 electrically conductive, heatadhesive materials No. 1 to No. 14 for plastic films, having the different compositions shown in Tables 2, 3 and 4, were prepared. Of the components of each material, low density polyethylene (LDPE) had melt index (MI) value of 7, and ethylene-vinyl acetate copolymer (EVA) contained 19 wt. % of vinyl acetate, and the carbon black was Ketjenbalck EC (trade name).

Plastic films having 100 μm were made by the inflation method. Lead alloy foils having a thickness of 30 μm were also formed of various Sn-Sb-Pb alloys containing Sn and Sb in the amounts shown also in Tables 2, 3 and 4. Two plastic films of each material were laminated on both surfaces of one of the foils at 130° C. under pressure of 5 kg/cm$^2$. thereby providing a laminated tape.

The laminated tapes, consisting of a lead alloy foil and two electrically conductive plastic films covering both surfaces of the foil, were tested to evaluate their properties. The results are shown in Tables 2, 3 and 4. The volume resistivity of electrically conductive plastic films shown in these tables was measured in the following way. The plastic films were cut into test pieces, each having a width of 50 mm and a length of 70 mm. Two strips of electrically conductive metal foil tape coated with a conductive tackifier and having a width of 10 mm, i.e., Al 7650 (manufactured by Sony Chemical Co., Ltd.) were pressbonded to the ends of each test piece and were used as electrodes. The test pieces were left to stand at 23° C. for 24 hours, with the relative humidity maintained at 55%. The strips of electrically conductive tape for electrodes were electrically connected to to a resistance meter, thereby detecting the electrical resistance of each plastic film. The volume resistivity of the film, ρv (Ω-cm) was then calculated by the following equation:

$$\rho v\ (\Omega\text{-cm}) = \frac{R(\Omega) \times 5(\text{cm}) \times d(\text{cm})}{5(\text{cm})} = Rd$$

In this equation, R is the electricrical resistance detected by the resistance meter, and d is the thickness of the film.

TABLE 2

| Samples | Component 1 EAA (AA %) 3.5 | 8.0 | Component 2 LDPE | EVA | Tafmer | Component 3 Carbon Black | Carbon Fiber | Graphite | Volume Resistivity (Ω-cm) | Lead Alloy Foil (wt %) Sn | Sb | Lead Laminated Tape with Two Films: Adhesivity | Fatigue Characteristic | Heat-sealability | Properties of Cable: Water Impervious ness | Bending Characteristic | Heat Cycle Efficiency |
|---|---|---|---|---|---|---|---|---|---|---|---|---|---|---|---|---|---|
| | Component 1: EAA | | | | | | | | | | | | | | | | |
| No. 1 | | 75 | | | | 25 | | | $7 \times 10^2$ | 3.5 | 5.5 | 5 | 5 | 5 | 5 | 5 | 5 |
| No. 2 | | 50 | 25 | | | 25 | | | $4 \times 10^2$ | " | " | 5 | 5 | 5 | 5 | 5 | 5 |
| No. 3 | 50 | | 25 | | | 25 | | | $5 \times 10^2$ | " | " | 5 | 5 | 5 | 5 | 5 | 5 |
| No. 4 | | 50 | | 25 | | 20 | 1 | 4 | $6 \times 10^2$ | " | " | 5 | 5 | 5 | 5 | 5 | 5 |
| No. 5 | | 75 | | | | 25 | | | $7 \times 10^2$ | 0 | 4.0 | 3 | 4 | 5 | 5 | 4 | 4 |
| No. 6 | 50 | | 25 | | | 25 | | | $4 \times 10^2$ | " | " | 3 | 4 | 5 | 5 | 4 | 4 |
| No. 7 | | 75 | | | | 25 | | | $7 \times 10^2$ | 2.0 | 2.0 | 4 | 3 | 5 | 5 | 4 | 3 |
| No. 8 | 50 | | 25 | | | 25 | | | $4 \times 10^2$ | " | " | 4 | 3 | 5 | 5 | 4 | 3 |
| No. 9 | | 75 | | | | 25 | | | $7 \times 10^2$ | 0 | 0 | 2 | 2 | 5 | 1 | 2 | 2 |
| No. 10 | 50 | | 25 | | | 25 | | | $4 \times 10^2$ | " | " | 2 | 2 | 5 | 1 | 2 | 2 |
| No. 11 | | 10 | 65 | | | 25 | | | $2 \times 10^2$ | 3.5 | 5.5 | 3 | 3 | 3 | 5 | 3 | 3 |
| No. 12 | 25 | | 50 | | | 25 | | | $4 \times 10^2$ | " | " | 3 | 3 | 3 | 5 | 3 | 3 |
| No. 13 | | 10 | 65 | | | 25 | | | $2 \times 10^2$ | 0 | 0 | 1 | 1 | 2 | 1 | 1 | 1 |
| No. 14 | 25 | | 50 | | | 25 | | | $4 \times 10^2$ | " | " | 1 | 1 | 2 | 1 | 1 | 1 |

TABLE 3

| Samples | Component 1 EAA (AA %) 7 | 18 | Component 2 LDPE | EVA | Tafmer | Component 3 Carbon Black | Carbon Fiber | Graphite | Volume Resistivity (Ω-cm) | Lead Alloy Foil (wt %) Sn | Sb | Lead Laminated Tape with Two Films: Adhesivity | Fatigue Characteristic | Heat-sealability | Properties of Cable: Water Impervious ness | Bending Characteristic | Heat Cycle Efficiency |
|---|---|---|---|---|---|---|---|---|---|---|---|---|---|---|---|---|---|
| | Component 1: EAA | | | | | | | | | | | | | | | | |
| No. 1 | | 75 | | | | 25 | | | $7 \times 10^2$ | 3.5 | 5.5 | 5 | 5 | 5 | 5 | 5 | 5 |
| No. 2 | | 50 | 25 | | | 25 | | | $8 \times 10^2$ | " | " | 5 | 5 | 5 | 5 | 5 | 5 |
| No. 3 | 50 | | 25 | | | 25 | | | $8 \times 10^2$ | " | " | 5 | 5 | 5 | 5 | 5 | 5 |
| No. 4 | | 50 | | | 25 | 25 | | | $8 \times 10^2$ | " | " | 5 | 5 | 5 | 5 | 5 | 5 |
| No. 5 | | 75 | | | | 25 | | | $7 \times 10^2$ | 0 | 4.0 | 3 | 4 | 5 | 5 | 4 | 4 |
| No. 6 | | 50 | 25 | | | 25 | | | $8 \times 10^2$ | " | " | 3 | 4 | 5 | 5 | 4 | 4 |
| No. 7 | | 75 | | | | 25 | | | $7 \times 10^2$ | 2.0 | 2.0 | 4 | 3 | 5 | 5 | 4 | 3 |
| No. 8 | | 50 | 25 | | | 25 | | | $8 \times 10^2$ | " | " | 4 | 3 | 5 | 5 | 4 | 3 |
| No. 9 | | 75 | | | | 25 | | | $7 \times 10^2$ | 0 | 0 | 2 | 2 | 5 | 1 | 1 | 1 |
| No. 10 | | 50 | 25 | | | 25 | | | $8 \times 10^2$ | " | " | 1 | 2 | 5 | 1 | 1 | 1 |
| No. 11 | 25 | | 50 | | | 25 | | | $9 \times 10^2$ | 3.5 | 5.5 | 3 | 3 | 3 | 5 | 3 | 3 |
| No. 12 | | 25 | 50 | | | 25 | | | $8 \times 10^2$ | " | " | 3 | 3 | 3 | 5 | 3 | 3 |
| No. 13 | 25 | | 50 | | | 25 | | | $9 \times 10^2$ | 0 | 0 | 1 | 1 | 2 | 1 | 1 | 1 |
| No. 14 | | 25 | 50 | | | 25 | | | $8 \times 10^2$ | " | " | 1 | 1 | 2 | 1 | 1 | 1 |

TABLE 4

| Component 1: Modified and Unmodified polyolefin | | | | | | | | |
|---|---|---|---|---|---|---|---|---|
| | Component 1 Additives | | Component 2 | | | Component 3 | | |
| Samples | Maleic Anhydride (0.5%) | Acrylic Acid (0.7%) | LDPE | EVA | Tafmer | Carbon Black | Carbon Fiber | Graphite |
| No. 1 | 75 | | | | | 25 | | |
| No. 2 | 50 | | 25 | | | 25 | | |
| No. 3 | | 50 | 25 | | | 25 | | |
| No. 4 | 50 | | 25 | | | 20 | 1 | 4 |
| No. 5 | 75 | | | | | 25 | | |
| No. 6 | | 50 | 25 | | | 25 | | |
| No. 7 | 75 | | | | | 25 | | |
| No. 8 | | 50 | 25 | | | 25 | | |
| No. 9 | 75 | | | | | 25 | | |
| No. 10 | | 50 | 25 | | | 25 | | |
| No. 11 | 25 | | 50 | | | 25 | | |
| No. 12 | | 25 | 50 | | | 25 | | |
| No. 13 | 25 | | 50 | | | 25 | | |
| No. 14 | | 25 | 50 | | | 25 | | |

| | | | | Lead Laminated Tape with Two Films | | | Properties of Cable | | |
|---|---|---|---|---|---|---|---|---|---|
| Samples | Volume Resistivity (Ω-cm) | Lead Alloy Foil (wt %) Sn | Lead Alloy Foil (wt %) Sb | Adhesivity | Fatigue Characteristic | Heat-sealability | Water Impervious-ness | Bending Characteristic | Heat Cycle Efficiency |
| No. 1 | $5 \times 10^2$ | 3.5 | 5.5 | 5 | 5 | 5 | 5 | 5 | 5 |
| No. 2 | $2 \times 10^2$ | " | " | 5 | 5 | 5 | 5 | 5 | 5 |
| No. 3 | $8 \times 10^2$ | " | " | 5 | 5 | 5 | 5 | 5 | 5 |
| No. 4 | $5 \times 10^2$ | " | " | 5 | 5 | 5 | 5 | 5 | 5 |
| No. 5 | $5 \times 10^2$ | 0 | 4.0 | 3 | 4 | 5 | 5 | 4 | 4 |
| No. 6 | $8 \times 10^2$ | " | " | 3 | 4 | 5 | 5 | 4 | 4 |
| No. 7 | $5 \times 10^2$ | 2.0 | 2.0 | 4 | 3 | 5 | 5 | 4 | 3 |
| No. 8 | $8 \times 10^2$ | " | " | 4 | 3 | 5 | 5 | 4 | 3 |
| No. 9 | $5 \times 10^2$ | 0 | 0 | 2 | 2 | 5 | 1 | 1 | 1 |
| No. 10 | $8 \times 10^2$ | " | " | 1 | 2 | 5 | 1 | 1 | 1 |
| No. 11 | $3 \times 10^2$ | 3.5 | 5.5 | 3 | 3 | 3 | 5 | 3 | 3 |
| No. 12 | $2 \times 10^2$ | " | " | 3 | 3 | 3 | 5 | 3 | 3 |
| No. 13 | $3 \times 10^2$ | 0 | 0 | 1 | 1 | 2 | 1 | 1 | 1 |
| No. 14 | $2 \times 10^2$ | " | " | 1 | 1 | 2 | 1 | 1 | 1 |

As Tables 2, 3 and 4 clearly show, the compositions of the lead alloy foils largely determine the properties of the lead laminated tapes with these foils and also the properties of the cables with these lead laminated tapes.

EXAMPLE 3

Fourteen electrically conductive, heat-adhesive materials No. 1 to No. 14 for plastic films, having the different compositions shown in Table 5, were prepared. Of the components of each material, low density polyethylene (LDPE) had MI value of 7, and ethylene-vinyl acetate copolymer (EVA) contained 19 wt. % of vinyl acetate, and the carbon black was Ketjenbalck EC (trade name).

Plastic films having 100 μm were made by the inflation method. Lead alloy foils having a thickness of 30 μm were also formed of various Sn-Sb-Pb alloys containing Sn and Sb in the amounts shown also in Table 5. One plastic film of each material was laminated on one surface of one of the foils at 130° C. under pressure of 5 kg/cm$^2$ thereby providing a laminated tape.

The laminated tapes, consisting of a lead alloy foil and one electrically conductive plastic film covering one surface of the foil, were tested in the same way as in Example 2 to evaluate their properties. The results are shown in Tables 5. The volume resistivity shown in Table 5 was measured in the same way as described above.

TABLE 5

| | | | | | | | | | | | | | | | | |
|---|---|---|---|---|---|---|---|---|---|---|---|---|---|---|---|---|
| | | | | | | | Lead Laminated Tape with One Plastic Film | | | | | | | | | |
| | | | | | | | | | | Lead Laminated Tape with Two Films | | | Properties of Cable | | |
| Samples | Component 1 EAA AA % 3.5 | Component 1 EAA AA % 8.0 | Component 2 LDPE | Component 2 EVA | Component 2 Tafmer | Component 3 Carbon Black | Component 3 Carbon Fiber | Component 3 Graphite | Volume Resistivity (Ω-cm) | Lead Alloy Foil (wt %) Sn | Lead Alloy Foil (wt %) Sb | Adhesivity | Fatigue Characteristic | Heat-sealability | Water Impervious-ness | Bending Characteristic | Heat Cycle Efficiency |
| No. 1 | | 75 | | | | 25 | | | $7 \times 10^2$ | 3.5 | 5.5 | 5 | 3 | 3 | 5 | 3 | 3 |
| No. 2 | | 50 | 25 | | | 25 | | | $4 \times 10^2$ | " | " | 5 | 3 | 3 | 5 | 3 | 3 |
| No. 3 | 50 | | 25 | | | 25 | | | $5 \times 10^2$ | " | " | 5 | 3 | 3 | 5 | 3 | 3 |

TABLE 5-continued

| Samples | Component 1 EAA AA % 3.5 | 8.0 | Component 2 LDPE | EVA | Tafmer | Component 3 Carbon Black | Carbon Fiber | Graphite | Volume Resistivity (Ω-cm) | Lead Alloy Foil (wt %) Sn | Sb | Lead Laminated Tape with Two Films: Adhesivity | Fatigue Characteristic | Heat-sealability | Properties of Cable: Water Impervious ness | Bending Characteristic | Heat Cycle Efficiency |
|---|---|---|---|---|---|---|---|---|---|---|---|---|---|---|---|---|---|
| Lead Laminated Tape with One Plastic Film | | | | | | | | | | | | | | | | | |
| No. 4 | | 50 | | 25 | | 20 | 1 | 4 | $6 \times 10^2$ | " | " | 5 | 3 | 3 | 5 | 3 | 3 |
| No. 5 | | 75 | | | | 25 | | | $7 \times 10^2$ | 0 | 4.0 | 3 | 3 | 3 | 5 | 3 | 3 |
| No. 6 | 50 | | 25 | | | 25 | | | $4 \times 10^2$ | " | " | 3 | 3 | 3 | 5 | 3 | 3 |
| No. 7 | | 75 | | | | 25 | | | $7 \times 10^2$ | 2.0 | 2.0 | 4 | 2 | 3 | 5 | 2 | 2 |
| No. 8 | 50 | | 25 | | | 25 | | | $4 \times 10^2$ | " | " | 4 | 2 | 3 | 5 | 2 | 2 |
| No. 9 | | 75 | | | | 25 | | | $7 \times 10^2$ | 0 | 0 | 2 | 1 | 2 | 1 | 1 | 1 |
| No. 10 | 50 | | 25 | | | 25 | | | $4 \times 10^2$ | " | " | 2 | 1 | 2 | 1 | 1 | 1 |
| No. 11 | | 10 | 65 | | | 25 | | | $2 \times 10^2$ | 3.5 | 5.5 | 3 | 3 | 3 | 5 | 3 | 3 |
| No. 12 | 25 | | 50 | | | 25 | | | $4 \times 10^2$ | " | " | 3 | 3 | 3 | 5 | 3 | 3 |
| No. 13 | | 10 | 65 | | | 25 | | | $2 \times 10^2$ | 0 | 0 | 1 | 1 | 1 | 1 | 1 | 1 |
| No. 14 | 25 | | 50 | | | 25 | | | $4 \times 10^2$ | " | " | 1 | 1 | 1 | 1 | 1 | 1 |

As Table 5 clearly shows, in this case, too, the compositions of the lead alloy foils largely determine the properties of the lead laminated tapes with these foils and also the properties of the cables with these lead laminated tapes.

EXAMPLE 4

Fourteen electrically conductive, heat-adhesive materials No. 1 to No. 14 for plastic films, having the different compositions shown in Table 6, were prepared. Further, 14 electrically insulating, heat-adhesive materials No. 1 to No. 14, having different compositions shown in Table 6, were prepared. Of the components of each material, low density polyethylene (LDPE) had MI value of 7, and ethylene-vinyl acetate copolymer (EVA) contained 19 wt. % of vinyl acetate, and the carbon black was Ketjenbalck EC (trade name).

Conductive plastic films having 100 μm were made by the inflation method. Insulating plastic films having 100 μm were also made by the inflation method. Lead alloy foils having a thickness of 30 μm were also formed of various Sn-Sb-Pb alloys containing Sn and Sb in the amounts shown also in Table 6. Each conductive plastic film and each insulative plastic film were laminated on the surface of one of the foils at 130° C. under pressure of 5 kg/cm$^2$, thereby providing a laminated tape.

The laminated tapes, consisting of a lead alloy foil, one electrically conductive plastic film covering one of the surfaces of the foil, and one electrically insulating plastic film covering the other surface of the foil, were tested in the same way as in Example 2 to evaluate their properties. The results are shown in Table 6. The volume resistivity shown in Table 6 was measured in the same way as described above.

TABLE 6

| Samples | Conductive Plastic Film: Component 1 Additives: Maleic Anhydride (0.5%) | Acrylic Acid (0.7%) | Component 2: LDPE | EVA | Tafmer | Component 3: Carbon Black | Carbon Fiber | Graphite | Volume Resistivity (Ω-cm) | Insulating Plastic Flim Component 1 Additives: Maleic Anhydride (0.5%) | Acrylic Acid (0.7%) |
|---|---|---|---|---|---|---|---|---|---|---|---|
| Lead Laminated Tape with Conductive and Insulating Plastic Films | | | | | | | | | | | |
| No. 1 | 75 | | | | | 25 | | | $5 \times 10^2$ | 75 | |
| No. 2 | 50 | | 25 | | | 25 | | | $2 \times 10^2$ | 50 | |
| No. 3 | | 50 | 25 | | | 25 | | | $8 \times 10^2$ | | 50 |
| No. 4 | 50 | | 25 | | | 20 | 1 | 4 | $5 \times 10^2$ | 50 | |
| No. 5 | 75 | | | | | 25 | | | $5 \times 10^2$ | 75 | |
| No. 6 | | 50 | 25 | | | 25 | | | $8 \times 10^2$ | | 50 |
| No. 7 | 75 | | | | | 25 | | | $5 \times 10^2$ | 75 | |
| No. 8 | | 50 | 25 | | | 25 | | | $8 \times 10^2$ | | 50 |
| No. 9 | 75 | | | | | 25 | | | $5 \times 10^2$ | 75 | |
| No. 10 | | 50 | 25 | | | 25 | | | $8 \times 10^2$ | | 50 |
| No. 11 | 25 | | 50 | | | 25 | | | $3 \times 10^2$ | 25 | |
| No. 12 | | 25 | 50 | | | 25 | | | $2 \times 10^2$ | | 25 |
| No. 13 | 25 | | 50 | | | 25 | | | $3 \times 10^2$ | 25 | |

TABLE 6-continued

| Lead Laminated Tape with Conductive and Insulating Plastic Films | | | | | | | | | | | |
|---|---|---|---|---|---|---|---|---|---|---|---|
| No. 14 | | 25 | 50 | | | 25 | | | $2 \times 10^2$ | | 25 |
| | Insulating Plastic Film Component 2 | | | Lead Alloy Foil (wt %) | | Lead Laminated Tape with Two Films | | | Properties of Cable | | |
| Samples | LDPE | EVA | Tafmer | Sn | Sb | Adhesivity | Fatigue Characteristic | Heat sealability | Water Impervious ness | Bending Characteristic | Heat Cycle Efficiency |
| No. 1 | | | | 3.5 | 5.5 | 5 | 5 | 5 | 5 | 5 | 5 |
| No. 2 | 25 | | | " | " | 5 | 5 | 5 | 5 | 5 | 5 |
| No. 3 | 25 | | | " | " | 5 | 5 | 5 | 5 | 5 | 5 |
| No. 4 | 25 | | | " | " | 5 | 5 | 5 | 5 | 5 | 5 |
| No. 5 | | | | 0 | 4.0 | 3 | 4 | 5 | 5 | 4 | 4 |
| No. 6 | 25 | | | " | " | 3 | 4 | 5 | 5 | 4 | 4 |
| No. 7 | | | | 2.0 | 2.0 | 4 | 3 | 5 | 5 | 4 | 3 |
| No. 8 | 25 | | | " | " | 4 | 3 | 5 | 5 | 4 | 3 |
| No. 9 | | | | 0 | 0 | 2 | 2 | 5 | 1 | 1 | 1 |
| No. 10 | 25 | | | " | " | 1 | 2 | 5 | 1 | 1 | 1 |
| No. 11 | 50 | | 3.5 | 5.5 | 3 | 3 | 3 | 5 | 3 | 3 | |
| No. 12 | 50 | | " | " | 3 | 3 | 3 | 5 | 3 | 3 | |
| No. 13 | 50 | | | 0 | 0 | 1 | 1 | 2 | 1 | 1 | 1 |
| No. 14 | 50 | | | " | " | 1 | 1 | 2 | 1 | 1 | 1 |

Note: All insulating plastic films had the same volume resistivity of $10^{16}$–$10^{17}$ Ω-cm.

As Table 6 clearly shows, the compositions of the lead alloy foils largely determine the properties of the lead laminated tapes consisting of this foil, a conductive plastic film and an insulating plastic film, and also the properties of the cables with these lead laminated tapes.

As described above, the lead alloy foil and the lead laminated tape of this invention, which comprises a lead alloy foil and an electrically conductive plastic film laminated on one surface of the foil, or two electrically conductive films laminated on both surfaces of the foil, or one electrically conductive plastic film and one electrically insulating film laminated on the surfaces of the foil, respectively, has good formability, great strength, excellent fatigue characteristic, high corrosion resistance, low pinhole density, good adhesiveness, and excellent cable formability. Hence, it can be effectively used as a water impervious layer or a chemical-resistant layer of power cables insulated with rubber or plastics, and is industrially very useful.

What is claimed is:

1. A lead laminated tape designed for covering cables, comprising:

a lead alloy foil consisting essentially of 1.0 to 4.0 wt. % of tin, 2.0 to 7.0 wt. % of antimony, and the balance being lead, wherein Sn/Sb ratio of 3 or less; and an electrically conductive plastic film laminated at least on one of the surfaces of the lead alloy foil and having a volume resistivity of $10^6$ Ω-cm or less.

2. The lead laminated tape according to claim 1, wherein an electrically insulating plastic film is laminated on one of the surfaces of said lead alloy foil, and an electrically conductive plastic film is laminated on the other surface of said lead alloy foil.

3. The lead laminated tape according to claim 1, wherein two electrically conductive plastic films are laminated on two surfaces of said lead alloy foil, respectively.

4. The lead laminated tape according to claim 1, wherein said electrically conductive plastic film is composed of:

(a) 40–100 parts by weight of a mixture comprising ethylene-acrylic acid copolymer and/or ethylene-ethyl acrylate copolymer, and/or unmodified polyolefin and modified polyolefin prepared by modifying polyolefin by unsaturated carboxylic acid or its derivatives, and an epoxy group-containing unsaturated compound, said unsaturated carboxylic acid or its derivatives and said epoxy group-containing unsaturated compound being used in an amount of 0.01–1.0 wt. % based on the mixture of the modified and unmodified polyolefins;

(b) 0–60 parts by weight of at least one polyolefin selected from the group consisting of polyethylene, ethylene-vinyl acetate copolymer and non-polar, polyolefin-based, low crystalline resin; and (c) 5–140 parts by weight of at least one electrically conductive material selected from the group consisting of carbon black, carbon fiber and graphite.

5. The lead laminated tape according to claim 1, wherein said lead alloy foil has a thickness of 10 to 80 μm, and said electrically conductive plastic film has a thickness of 30 to 200 μm.

6. The lead laminated tape according to claim 1, wherein said electrically conductive plastic film is laminated directly on said lead alloy foil.

7. The lead laminated tape according to claim 1, wherein said electrically conductive plastic film is adhered to said lead alloy foil by an electrically conductive adhesive.

8. The lead laminated tape according to claim 2, wherein each of said electrically insulating plastic film and said electrically conductive plastic film is laminated directly on said lead alloy foil.

9. The lead laminated tape according to claim 2, wherein said electrically insulating plastic film and said electrically conductive plastic film are laminated on said lead alloy foil with an electrically insulating adhesive and an electrically conductive adhesive, respectively.

10. The lead laminated tape according to claim 2, wherein said electrically insulating plastic film is laminated directly on the lead alloy foil, and said electrically conductive plastic film is laminated on the lead alloy foil with an electrically conductive adhesive.

11. The lead laminated tape according to claim 2, wherein said electrically insulating plastic film is laminated on the lead alloy foil with an electrically insulating adhesive, and said electrically conductive plastic film is laminated directly on the lead alloy foil.

12. In a power cable of the type having a conductor, a conductor shield covering the conductor, an insulation layer and a covering layer, the improvement comprising a water impervious layer formed of a lead laminated tape formed of a lead alloy foil consisting essentially of 1.0 to 4.0 wt. % of tin, 2.0 to 7.0 wt. % of antimony, and the balance being lead, wherein the Sn/Sb ratio is 3 or less; and an electrically conductive plastic film laminated at least on one of the surfaces of the lead alloy foil and having a volume resistivity of $10^6$ ohms-cm or less, said electrically conductive plastic film being composed of: (a) 40–100 parts by weight of a mixture comprising ethylene-acrylic acid copolymer and/or ethylene-ethyl acrylate copolymer, and/or unmodified polyolefin and modified polyolefin prepared by modifying polyolefin by unsaturated carboxylic acid or its derivatives, and an epoxy group-containing unsaturated compound, said unsaturated carboxylic acid or its derivatives and said epoxy group-containing unsaturated compound being used in an amount of 0.01–1.0 wt. % based on the mixture of the modified and unmodified polyolefins; (b) 0–60 parts by weight of at least one polyolefin selected from the group consisting of polyethylene, ethylene-vinyl acetate copolymer and non-polar, polyolefin-based low crystalline resin; and (c) 5–140 parts by weight of at least one electrically conductive material selected from the group consisting of carbon black, carbon fiber and graphite.

13. The power cable according to claim 12 further comprising an electrically insulating plastic film laminated on one of the surfaces of said lead alloy foil, said electrically conductive plastic film being laminated on the other surface of said lead foil.

14. The power cable according to claim 12, wherein said lead alloy foil has a thickness of 10 to 80 microns, and said electrically conductive plastic film has a thickness of 30 to 200 microns.

* * * * *